US012669292B2

(12) United States Patent
Mandel et al.

(10) Patent No.: US 12,669,292 B2
(45) Date of Patent: Jun. 30, 2026

(54) PHASE CHANGE MATERIAL HEAT EXCHANGER

(71) Applicant: Hamilton Sundstrand Corporation, Charlotte, NC (US)

(72) Inventors: Raphael Mandel, West Hartford, CT (US); Joseph E. Turney, Amston, CT (US); Ram Ranjan, San Diego, CA (US)

(73) Assignee: HAMILTON SUNDSTRANG CORPORATION, Charlotte, NC (US)

( * ) Notice: Subject to any disclaimer, the term of this patent is extended or adjusted under 35 U.S.C. 154(b) by 207 days.

(21) Appl. No.: 18/532,411

(22) Filed: Dec. 7, 2023

(65) Prior Publication Data

US 2025/0189237 A1 Jun. 12, 2025

(51) Int. Cl.
*F28D 15/00* (2006.01)
*F28F 21/06* (2006.01)
*F28F 23/00* (2006.01)

(52) U.S. Cl.
CPC ..... *F28D 15/00* (2013.01); *F28F 21/062* (2013.01); *F28F 23/00* (2013.01); *F28F 2255/06* (2013.01)

(58) Field of Classification Search
CPC ..... F28D 20/021; F28D 2020/0021
See application file for complete search history.

(56) References Cited

U.S. PATENT DOCUMENTS 4,463,799 A * 8/1984 Takahashi ..... C09K 5/06 264/483
5,220,954 A * 6/1993 Longardner ..... F28D 20/021 165/104.11
5,441,097 A * 8/1995 Kanda ..... F28D 20/02 165/104.11
6,889,755 B2 5/2005 Zuo et al.
9,410,748 B2 8/2016 Schneider et al.
11,098,960 B2 8/2021 Joshi
2007/0029064 A1* 2/2007 Baginski ..... F28D 20/021 165/10
2011/0259544 A1* 10/2011 Neti ..... F28D 20/023 165/10
2015/0284616 A1* 10/2015 Dhau ..... C25D 7/00 252/75
2016/0201995 A1* 7/2016 Oliva Llena ..... F28F 21/04 165/10
2019/0277575 A1* 9/2019 Li ..... F28F 21/083

(Continued)

FOREIGN PATENT DOCUMENTS

JP S5776078 A 5/1982
JP S58108391 A 6/1983

(Continued)

OTHER PUBLICATIONS

Extended European Search Report dated Apr. 2, 2025, for corresponding European Patent Application No. 24215222.1, 7 pgs.

*Primary Examiner* — Devon Lane
(74) *Attorney, Agent, or Firm* — Kinney & Lange, P.A.

(57) ABSTRACT

A heat exchanger includes an outer shell enclosing an interior space. An inlet extends through the outer shell and is in fluidic communication with the interior space. An outlet extends through the outer shell and is in fluidic communication with the interior space. At least one phase change element is inside the interior space and includes a core comprising a phase change material.

16 Claims, 8 Drawing Sheets

(56) References Cited

U.S. PATENT DOCUMENTS

| | | | | |
|---|---|---|---|---|
| 2020/0172783 | A1* | 6/2020 | Wei | C08L 91/06 |
| 2021/0127890 | A1* | 5/2021 | Baston | A47J 41/022 |
| 2023/0092044 | A1* | 3/2023 | Stojanovic | A47C 27/20 |

FOREIGN PATENT DOCUMENTS

| | | | | |
|---|---|---|---|---|
| JP | 62172191 | A | * | 1/1986 |
| JP | S62172191 | A | | 7/1987 |
| JP | H01212893 | A | | 8/1989 |
| JP | 07229690 | A | * | 9/1994 |

* cited by examiner

PHASE CHANGE MATERIAL HEAT EXCHANGER

BACKGROUND

This disclosure relates generally to thermal management systems in aircraft and, more particularly, to heat exchangers in aircraft.

Thermal energy storage can significantly reduce the size, weight, and power consumption of Thermal Management Systems (TMS) with transient heat loads by shaving the peak loads of the TMS, allowing the TMS to be designed for average load rather than peak. Typically, thermal energy storage is accomplished by using a phase change material (PCM), such as a paraffin wax, which undergoes a phase change, such as melting and freezing, to latently absorb and release stored energy. The PCM replaces one fluid in a conventional heat exchanger, such as an air side of the heat exchanger. PCM heat exchangers can be relatively heavy. Reducing the weight of PCM heat exchangers while increasing specific thermal energy storage (KJ/kg) of PCM heat exchangers is particularly important in aerospace applications where reducing mass increases fuel efficiency of aircraft.

SUMMARY

In one example of the disclosure, a heat exchanger includes an outer shell enclosing an interior space. An inlet extends through the outer shell and is in fluidic communication with the interior space. An outlet extends through the outer shell and is in fluidic communication with the interior space. At least one phase change element is inside the interior space and includes a core comprising a phase change material.

In another example of the disclosure, a heat exchanger includes a plurality of phase change elements. Each phase change element of the plurality of phase change elements includes a core with a phase change material. An outer housing surrounds the plurality of phase change elements and form flow channels between the outer housing and the plurality of phase change elements. An inlet is formed in the outer housing and is in fluidic communication with the flow channels. An outlet is formed in the outer housing and is in fluidic communication with the flow channels.

The present summary is provided only by way of example, and not limitation. Other aspects of the present disclosure will be appreciated in view of the entirety of the present disclosure, including the entire text, claims and accompanying figures.

Figure 1:
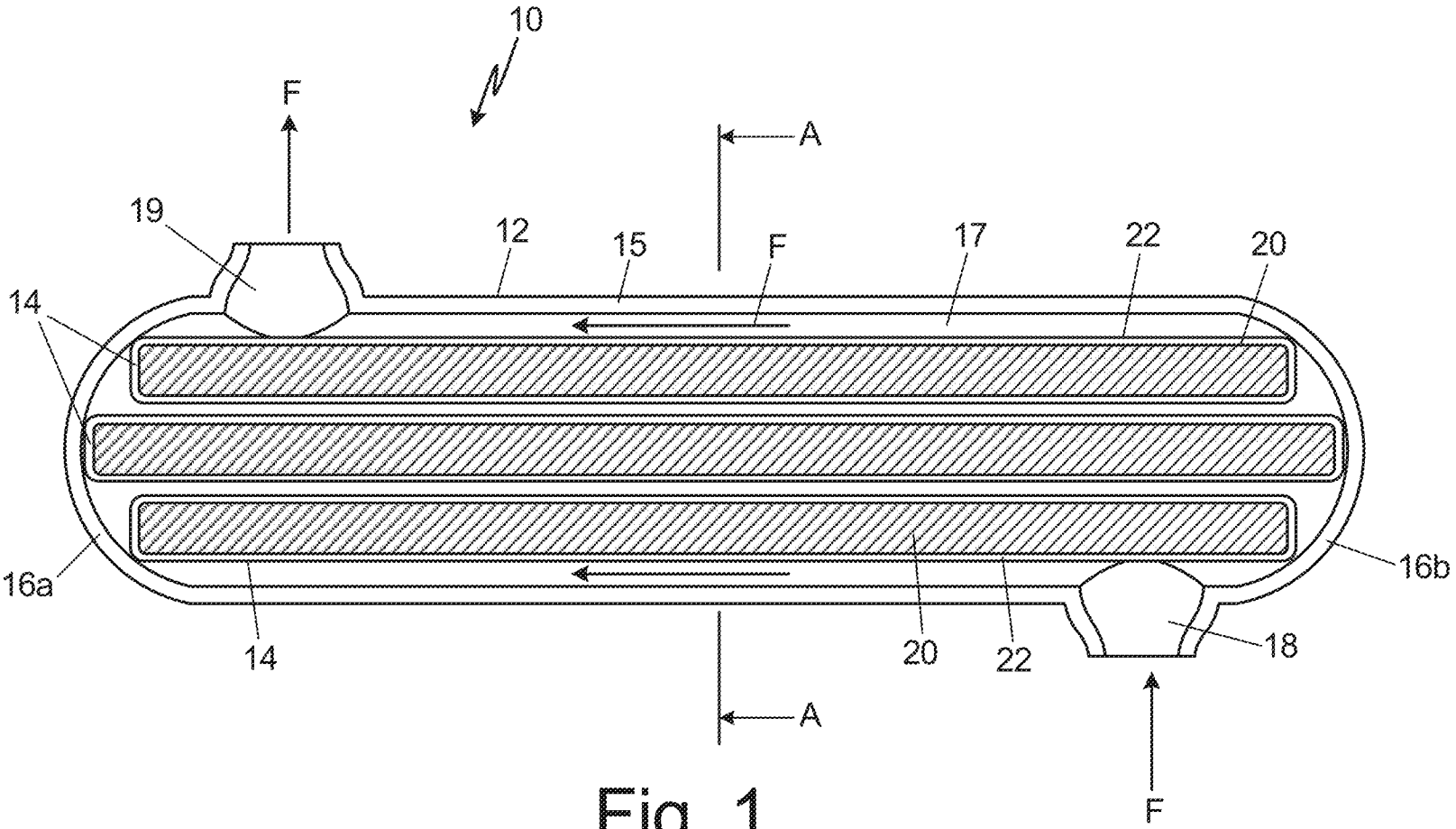
FIG. 1 is a cross-sectional view of a heat exchanger with cylindrically shaped phase change elements inside of an outer housing.

While the above-identified figures set forth embodiments of the present invention, other embodiments are also contemplated, as noted in the discussion. In all cases, this disclosure presents the invention by way of representation and not limitation. It should be understood that numerous other modifications and embodiments can be devised by those skilled in the art, which fall within the scope and spirit of the principles of the invention. The figures may not be drawn to scale, and applications and embodiments of the present invention may include features, steps and/or components not specifically shown in the drawings.

DETAILED DESCRIPTION

A heat exchanger is disclosed that includes an outer housing or shell and phase change elements within the outer housing. Each of the phase change elements includes a core made from a phase change material, such as paraffin wax. The core of each of the phase change elements is completely covered by a membrane. The membrane is made from a material that is impermeable to the phase change material of the core. The membrane is also impermeable to a coolant inside of the outer housing and in direct contact with the membrane. The material of the membrane is also elastic, allowing the membrane to expand and contract as the core melts and resolidifies. The phase change elements can include various geometries that increase the surface area of the phase change elements and increase heat transfer between the coolant and the phase change elements. As the phase change elements are in direct contact with the coolant inside of the outer housing, the outer housing is not required as a path for heat transfer and can be shaped to withstand relatively high pressures and formed from a light-weight material, such as carbon fiber composite. The heat exchanger is described in detail below with reference to FIGS. 1-4.

Figure 2:
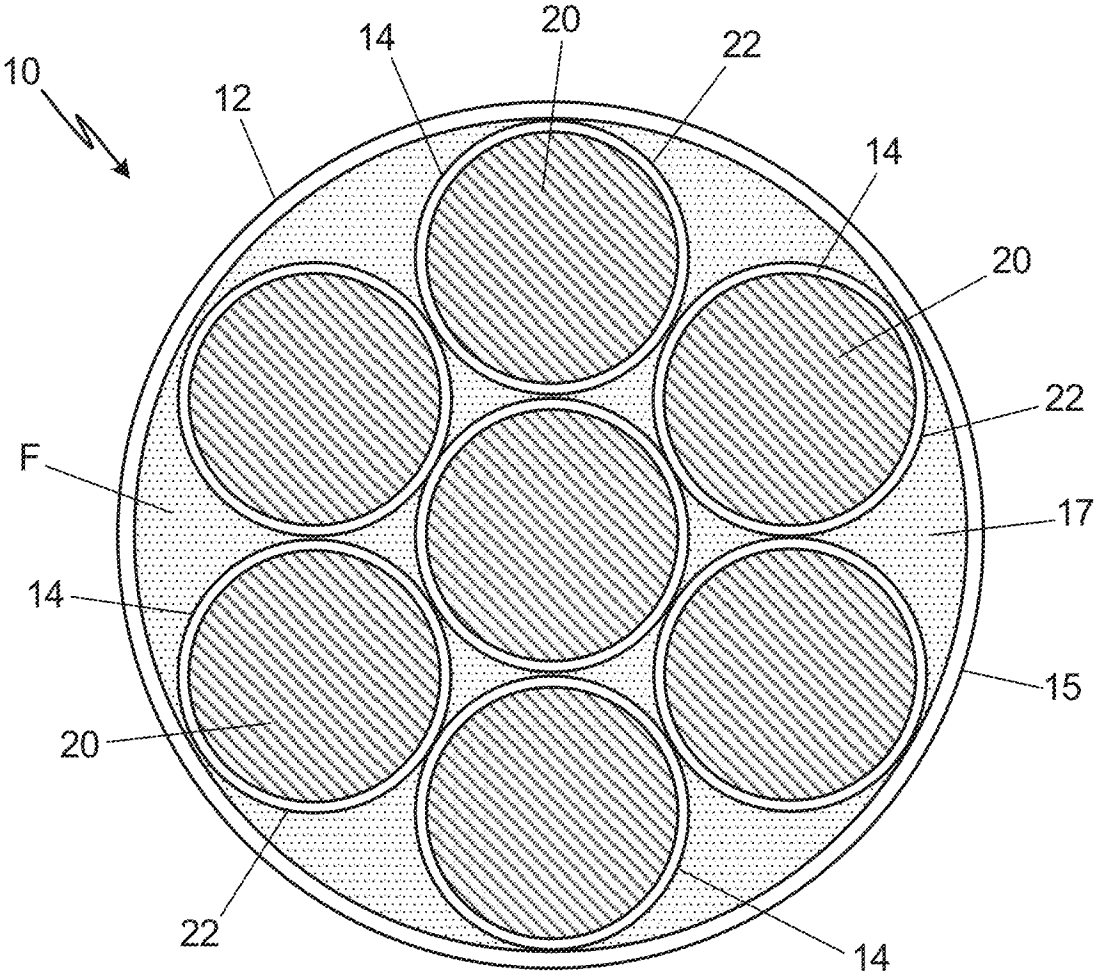
FIG. 2 is a cross-sectional view of the heat exchanger taken along line A-A from FIG. 1.

FIGS. 1 and 2 will be discussed concurrently. FIG. 1 is a cross-sectional view of heat exchanger 10 with outer housing 12 and a plurality of phase change elements 14. FIG. 2 is a cross-sectional view of heat exchanger 10 taken along line A-A from FIG. 1. As shown in the example of heat exchanger 10 in FIGS. 1 and 2, outer housing 12 can include cylindrical tube portion 15, first end 16*a*, second end 16*b*, interior space 17, inlet 18, and outlet 19. Each phase change element 14 can include core 20 and membrane 22. Coolant fluid F is also shown flowing through heat exchanger 10.

Outer housing 12 forms an outer shell of heat exchanger 10 that encloses interior space 17. Cylindrical tube portion 15 forms most of a length of outer housing 12, and first end 16*a* is connected to cylindrical tube portion 15 opposite second end 16*b*. First end 16*a* and second end 16*b* can both be hemispherical in shape such that first end 16*a*, second end 16*b*, and cylindrical tube portion 15 form outer housing 12 into a capsule-shaped pressure vessel capable of handling a pressurized flow of coolant fluid F. In other examples, outer housing 12 can be spherically shaped, elliptically shaped, or any other shape ideal for containing a pressurized flow of coolant fluid F. Outer housing 12 can also be formed from a composite material, such as carbon fiber composite, to reduce an overall weight of heat exchanger 10 and to increase a pressure holding capacity of outer housing 12. Inlet 18 is formed in outer housing 12 and extends through outer housing 12 such that inlet 18 is in fluidic communication with interior space 17. Outlet 19 is also formed in outer housing 12 and extends through outer housing 12 such that outlet 19 is in fluidic communication with interior space 17.

Phase change elements 14 are in interior space 17 within outer housing 12. Outer housing 12 surrounds phase change elements 14 to form flow channels between outer housing 12 and phase change elements 14. Phase change elements 14 can also be arranged relative to each other within interior space 17 to form flow channels between phase change elements 14. In the example of FIGS. 1 and 2, each phase change element 14 is cylindrical in shape and extends inside of outer housing 12 from first end 16*a* to second end 16*b*. The plurality of phase change elements 14 are arranged together such that phase change elements 14 are stacked in layers and are generally parallel with cylindrical tube portion 15 of outer housing 12. Each phase change element 14 includes core 20 and membrane 22. Core 20 includes a phase change material that changes phases from a solid to a liquid as core 20 absorbs heat from coolant fluid F during operation of heat exchanger 10. The phase change material can be selected from, but is not limited to, the group comprising paraffin wax, hydrated salts, fatty acids, ice/water, low melting point metals (such as gallium or other metals with a melting point below 200° F.), and shape memory alloys. Membrane 22 completely covers core 20 and is made of an elastic material that is impermeable and chemically non-reactive to the phase change material, and impermeable and chemically non-reactive to coolant fluid F. The elastic material of membrane 22 also allows membrane 22 to expand and contract as the phase change material of core 20 phase changes and cycles back and forth from a solid to a liquid. In some examples, the elastic material of membrane 22 can include rubber. For example, the elastic material of membrane 22 can be ethylene propylene diene monomer (EPDM).

During operation of heat exchanger 10, a flow of coolant fluid F enters heat exchanger 10 through inlet 18. After entering heat exchanger 10, the flow of coolant fluid F enters interior space 17 and flows through the flow channels between phase change elements 14 and the flow channels between outer housing 12 and phase change elements 14. As coolant fluid F flows between and around phase change elements 14, phase change elements 14 absorb heat from coolant fluid F. As phase change elements 14 absorb heat from coolant fluid F, core 20 of each phase change element 14 can begin to melt and change phase from a solid to a liquid. Membrane 22 of each phase change element 14 helps phase change element 14 retain structure and prevents the flow of coolant fluid F from eroding core 20. Membrane 22 also prevents core 20 from chemically interacting with coolant fluid F. After coolant fluid F flows between and around phase change elements 14, coolant fluid F exits interior space 17 through outlet 19.

Heat transfer between coolant fluid F and phase change elements 14 is faster than conventional heat exchangers because phase change elements 14 are in direct contact with coolant fluid F. Performance of heat exchanger 10 is not dependent on heat transferring across outer housing 12 to an outside medium. Rather, outer housing 12 serves as a pressure vessel that allows coolant fluid F to flow through heat exchanger 10 at a higher rate than conventional heat exchangers. While phase change elements 14 are shown as having a cylindrical shape in the example of FIGS. 1 and 2, phase change elements 14 can have any shape that creates internal flow channels. Some alternative examples of phase change elements 14 are discussed below with reference to FIGS. 3 and 4.

Figure 3:
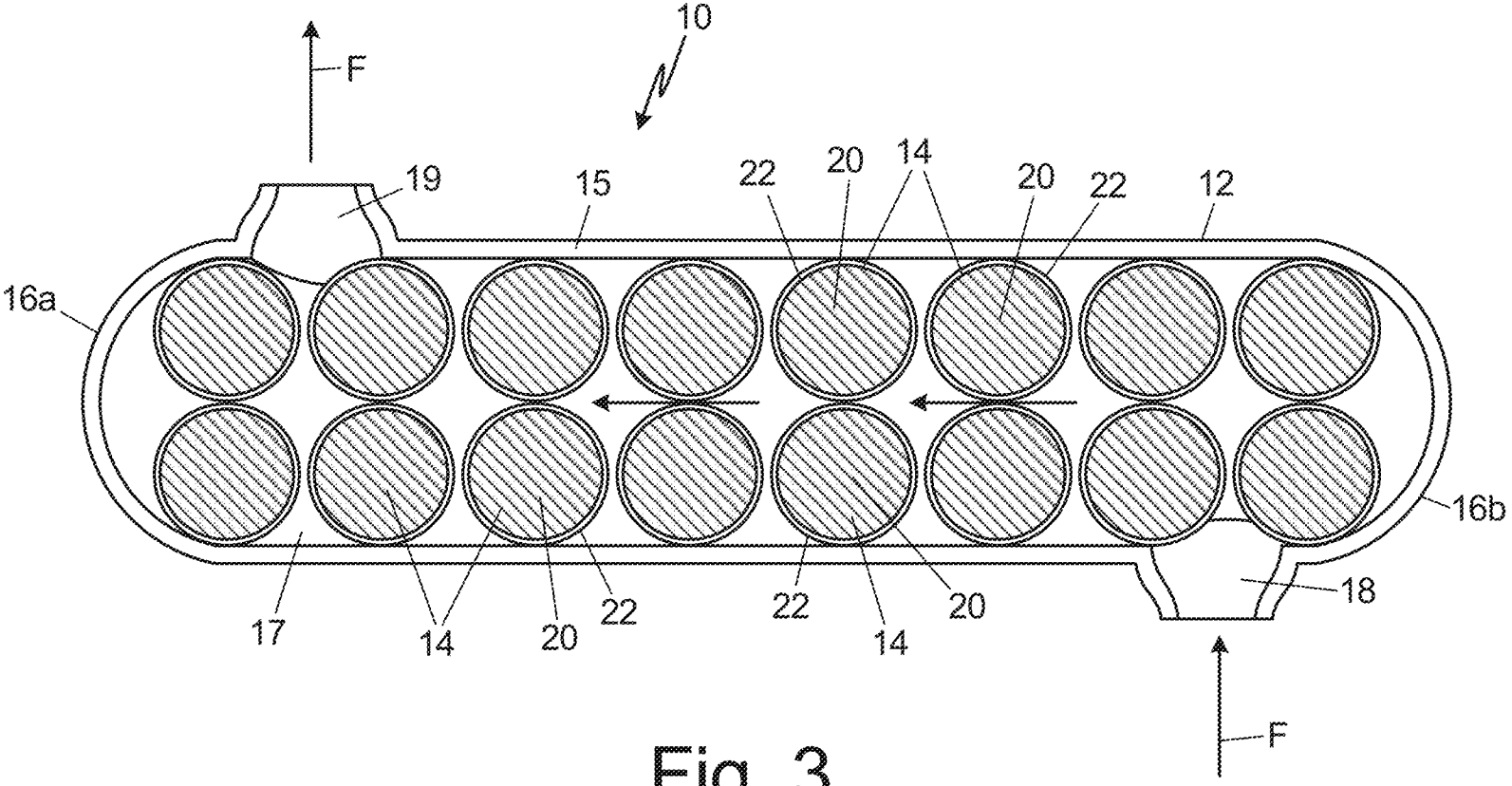
FIG. 3 is a cross-sectional view of another example of a heat exchanger with spherically shaped phase change elements inside of an outer housing.

FIG. 3 is a cross-sectional view of another example of heat exchanger 10 with phase change elements 14 that are spherically shaped. Each of the spherically shaped phase change elements 14 can include a diameter that is larger than a diameter of inlet 18 and a diameter of outlet 19, thereby preventing phase change elements 14 from being carried out of heat exchanger 10 by the flow of coolant fluid F. As shown in FIG. 3, core 20 of each phase change element 14 can be spherical. The spherically shaped phase change elements 14 are stacked within interior space 17 so as to form flow channels between phase change elements 14, and to form flow channels between outer housing 12 and phase change elements 14.

Figure 4:
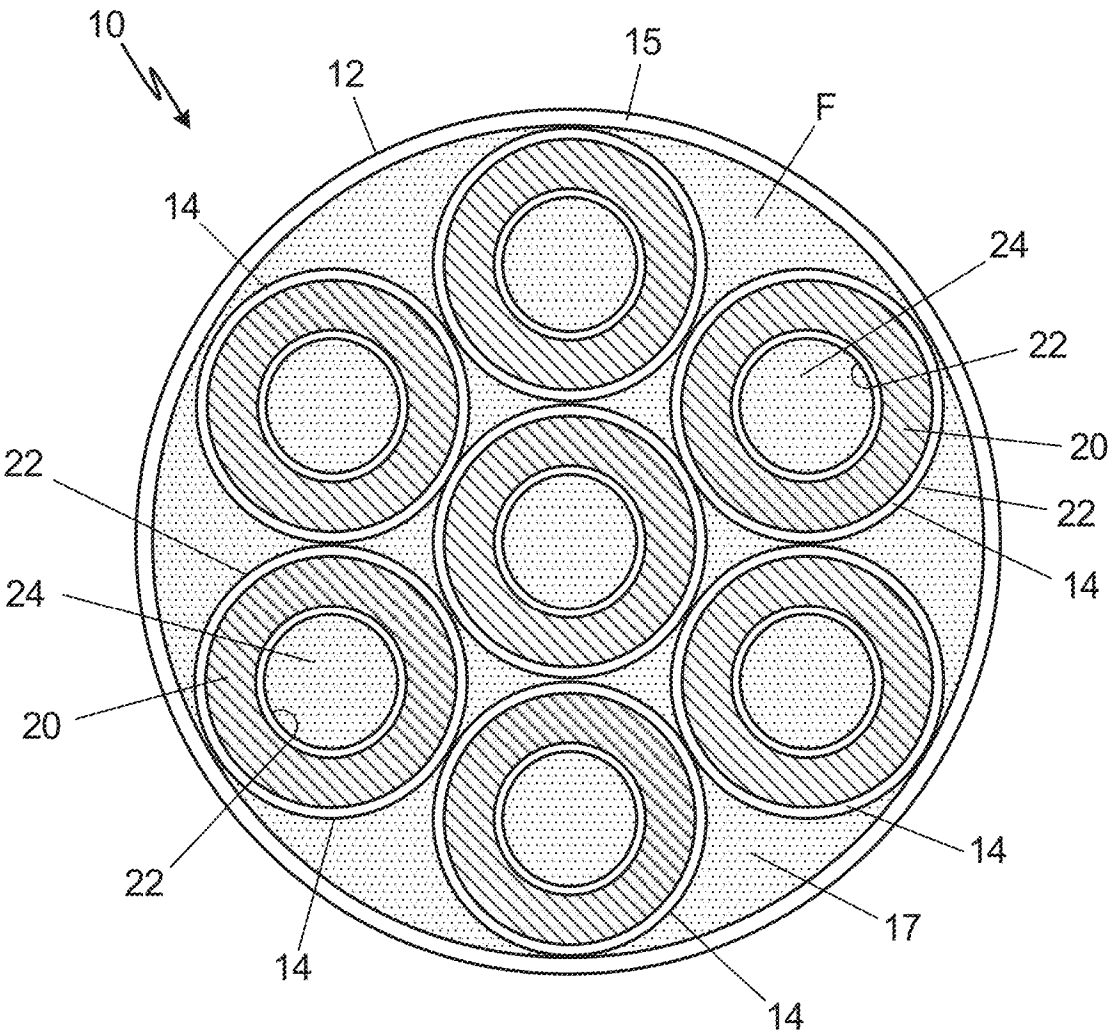
FIG. 4 is a cross-sectional view of another example of a heat exchanger with tube shaped phase change elements inside of an outer housing.

FIG. 4 is a cross-sectional view of another example of heat exchanger 10 with phase change elements 14 that are tubular in shape with center passage 24 extending along a center of each phase change element 14. In the example of FIG. 4, core 20 is tube shaped and membrane 22 completely covers core 20 such that membrane 22 lines center passage 24, covers a radial outer surface of core 20, and covers the ends of core 20. During operation of heat exchanger 10, coolant fluid F flows between phase change elements 14, between phase change elements 14 and outer housing 12, and inside of center passage 24 of each phase change element 14. Center passage 24 increases the surface area of each phase change element 14 over the example of FIGS. 1 and 2.

Figure 5:
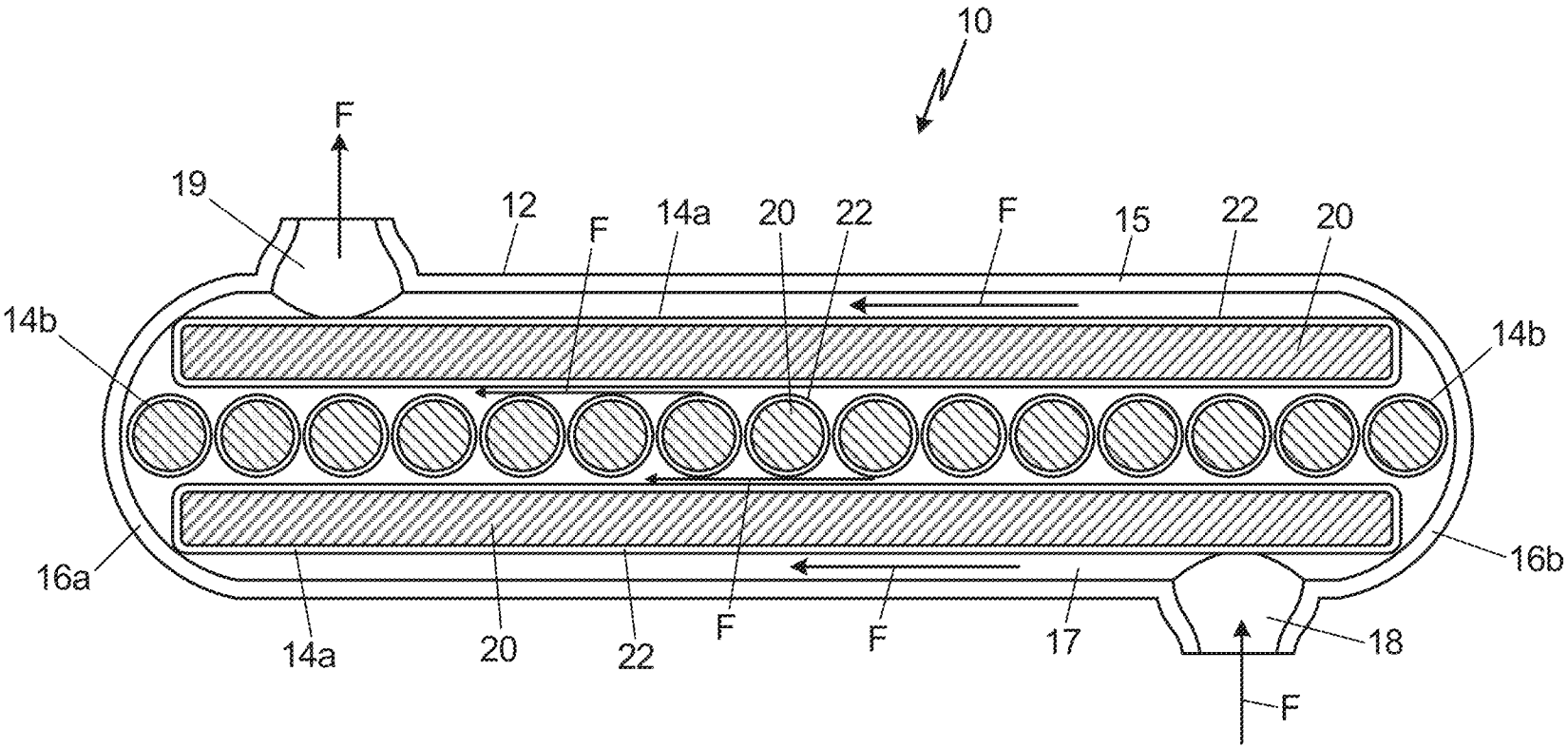
FIG. 5 is a cross-sectional view of another example of a heat exchanger with cylindrically shaped phase change elements and spherically shaped phase change elements inside of an outer housing.

FIG. 5 is a cross-sectional view of another example of heat exchanger 10 with cylindrically shaped phase change elements 14*a* and spherically shaped phase change elements 14*b*. In the example of FIG. 5, the cylindrically shaped phase change elements 14*a* surround the spherically shaped phase change elements 14*b* such that the cylindrically shaped phase change elements 14*a* hold the spherically shaped phase change elements 14*b* in place. The spherically shaped phase change elements 14*b* are positioned along a center axis of outer housing 12 and interior space 17, and the cylindrically shaped phase change elements 14*a* extend circumferentially around the spherically shaped phase change elements 14*b*. With the cylindrically shaped phase change elements 14*a* extending circumferentially around the spherically shaped phase change elements 14*b*, the cylindrically shaped phase change elements 14*b* prevent the spherically shaped phase change elements 14*a* from moving toward outlet 19 or inlet 18 and exiting outer housing 12.

Figure 6:
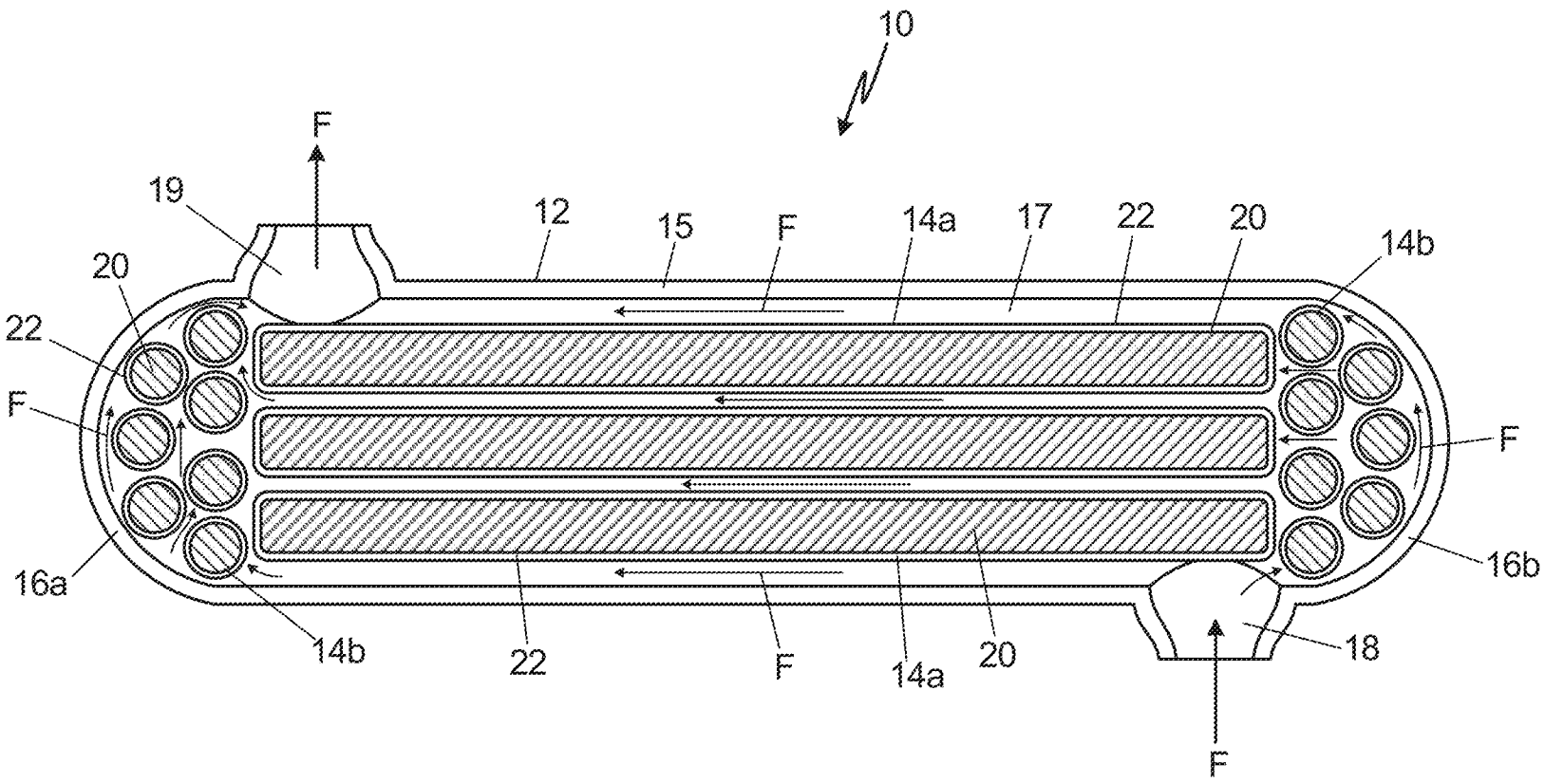
FIG. 6 is a cross-sectional view of another example of a heat exchanger with cylindrically shaped phase change elements and spherically shaped phase change elements inside of an outer housing.

FIG. 6 is a cross-sectional view of another example of heat exchanger 10 with cylindrically shaped phase change elements 14*a* and spherically shaped phase change elements 14*b* inside of outer housing 12. In the example of FIG. 6, the cylindrically shaped phase change elements 14*a* extend axially within interior space 17 of cylindrical tube portion 15 of outer housing 12. The cylindrical shaped phase change elements 14*a* extend past outlet 19 toward first end 16*a* of outer housing 12 and extend past inlet 18 toward second end 16*b* of outer housing 12. The spherically shaped phase change elements 14*b* are located in the hemispherical shape of first end 16*a* and within the hemispherical shape of second end 16*b* of outer housing 12. The spherically shaped phase change elements 14*b* increase the total surface area of phase changes elements 14 over the example of FIGS. 1 and 2 while the cylindrically shaped phase change elements 14*a* hold the spherically shaped phase change elements 14*b* in place and prevent the spherically shaped phase change elements 14*b* from moving toward outlet 19 or inlet 18 and exiting outer housing 12.

Figure 7:
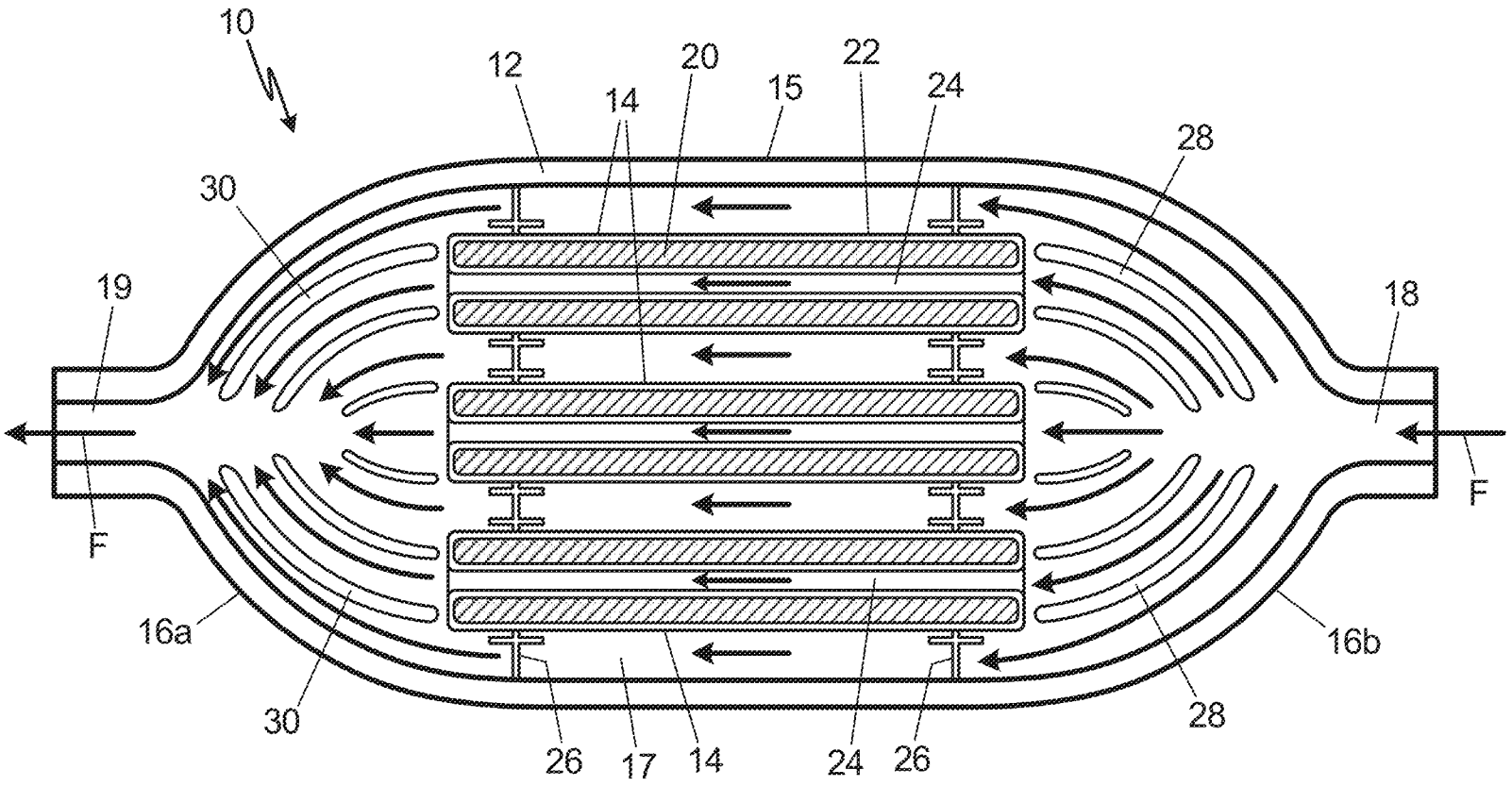
FIG. 7 is a cross-sectional view of another example of a heat exchanger with tube shaped phase change elements supported inside of an outer housing by a set of racks.

FIG. 7 is a cross-sectional view of another example of heat exchanger 10 with phase change elements 14 supported inside of outer housing 12 by racks 26. Phase change elements 14 in the example of FIG. 7 can be tube shaped and similar to the phase change elements 14 in the example of FIG. 4 with center passage 24 extending along a center of each phase change element 14. In the example of FIG. 7, core 20 of each phase change element 14 is tube shaped with membrane 22 completely covering core 20. Racks 26 are rigid support frames inside of outer housing 12 and connected to outer housing 12. Phase change elements 14 are inserted into racks 26 such that racks 26 physically support phase change elements 14 and space phase change elements 14 apart from one another. Heat exchanger 10 can also include a first plurality of flow guide channels 28 and a second plurality of flow guide channels 30. The first plurality of flow guide channels 28 are formed in the hemispherical shape of second end 16*b* of outer housing 12. The second plurality of flow guide channels 30 are formed in the hemispherical shape of first end 16*a* of outer housing 12.

During operation of the example of heat exchanger 10 shown in FIG. 7, coolant fluid F flows into heat exchanger 10 through inlet 18 and then coolant fluid F is guided into and around phase change elements 14 by the first plurality of flow guide channels 28. Coolant fluid F then flows across phase change elements 14 and racks 26. As coolant fluid F flows though, between, and around phase change elements 14, phase change elements 14 absorb heat from coolant fluid F. As phase change elements 14 absorb heat from coolant fluid F, core 20 of each phase change element 14 may begin to melt and change phase from a solid to a liquid. Membrane 22 of each phase change element 14 helps phase change element 14 retain structure and prevents the flow of coolant fluid F from eroding core 20. Membrane 22 also prevents core 20 from chemically interacting with coolant fluid F. Racks 26 can provide additional support to membrane 22 and core 20 as membrane 22 and core 20 warm up and possibly decrease in firmness. After coolant fluid F flows past phase change elements 14, the second plurality of flow guide channels 30 guides the flow of coolant fluid F toward outlet 19.

Figure 8:
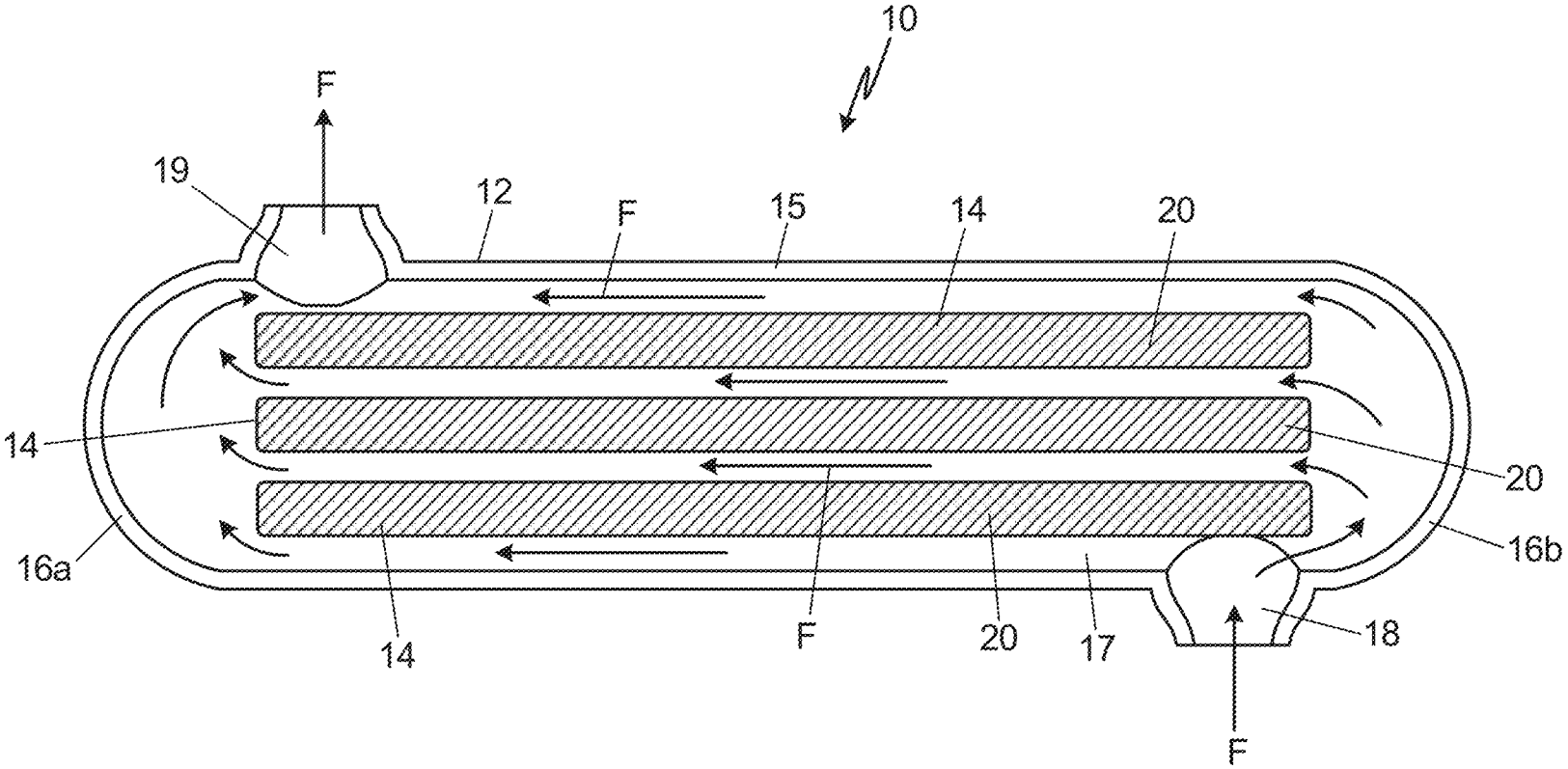
FIG. 8 is a cross-sectional view of another example of a heat exchanger with phase change elements made from a shape memory alloy.

FIG. 8 is a cross-sectional view of another example of heat exchanger 10 with phase change elements 14 with a core 20 made from a shape memory alloy. The shape memory alloy can include, but is not limited to, a copper-aluminum-nickel alloy, a nickel-titanium alloy, an iron-manganese-silicon alloy, a copper-zinc-aluminum alloy, a copper-aluminum-nickel alloy, a zinc-copper-gold-iron alloy, and/or combinations thereof. The shape memory alloy can reversibly transition between two phases: an austenite phase and a martensite phase. Because the shape memory alloy remains a solid between the two phases, core 20 of each phase change element 14 in the example of FIG. 8 does not require a membrane.

During operation of the example of heat exchanger 10 shown in FIG. 8, coolant fluid F flows into heat exchanger 10 through inlet 18 and enters second end 16*b* of outer housing 12. Coolant fluid F then flows between and around phase change elements 14. As coolant fluid F flows between and around phase change elements 14, phase change elements 14 absorb heat from coolant fluid F. As phase change elements 14 absorb heat from coolant fluid F, core 20 of each phase change element 14 transitions from the martensite phase to the austenite phase. After coolant fluid F flows past phase change elements 14, the second plurality of flow guide channels 30 guides the flow of coolant fluid F toward outlet 19. When operation of heat exchanger 10 ends, phase change elements 14 cool and core 20 of each phase change element 14 transitions from the austenite phase to the martensite phase.

Discussion of Possible Embodiments

The following are non-exclusive descriptions of possible embodiments of the present invention.

In one example, a heat exchanger includes an outer shell enclosing an interior space. An inlet extends through the outer shell and is in fluidic communication with the interior space. An outlet extends through the outer shell and is in fluidic communication with the interior space. At least one phase change element is inside the interior space and includes a core comprising a phase change material.

The heat exchanger of the preceding paragraph can optionally include, additionally and/or alternatively, any one or more of the following features, configurations and/or additional components:

- the phase change material is selected from the group comprising paraffin wax, hydrated salts, fatty acids, ice/water, shape memory alloys, gallium, and other metals with a melting point below 200° F.;
- the at least one phase change element further comprises a membrane completely covers the core and includes an elastic material that is impermeable to the phase change material and a coolant fluid in the heat exchanger;
- the elastic material comprises rubber;
- the elastic material comprises ethylene propylene diene monomer;
- the at least one phase change element is spherical in shape;
- the core of the at least one phase change element is spherical in shape;
- the at least one phase change element comprises a diameter that is larger than a diameter of the outlet and larger than a diameter of the inlet;
- the at least one phase change element is cylindrical in shape;
- the phase change element is tubular in shape; and/or
- the outer shell is a capsule-shaped pressure vessel formed from a composite material.

In another example of the disclosure, a heat exchanger includes a plurality of phase change elements. Each phase change element of the plurality of phase change elements includes a core with a phase change material. An outer housing surrounds the plurality of phase change elements and form flow channels between the outer housing and the plurality of phase change elements. An inlet is formed in the outer housing and is in fluidic communication with the flow channels. An outlet is formed in the outer housing and is in fluidic communication with the flow channels.

The heat exchanger of the preceding paragraph can optionally include, additionally and/or alternatively, any one or more of the following features, configurations and/or additional components:

- each phase change element of the plurality of phase change elements is spherical in shape;
- the core of each phase change element of the plurality of phase change elements is spherical in shape;
- each phase change element of the plurality of phase change elements is cylindrical in shape;

each phase change element of the plurality of phase change elements is tubular in shape;

the outer housing is a pressure vessel formed from a composite material;

the phase change material is selected from the group comprising paraffin wax, hydrated salts, fatty acids, ice/water, shape memory alloys, gallium, and other metals with a melting point below 200° F.;

each phase change element of the plurality of phase change elements further comprises a membrane completely covering the core and comprising an elastic material that is impermeable to the phase change material;

the elastic material comprises rubber;

the elastic material comprises ethylene propylene diene monomer; and/or the elastic material is chemically non-reactive to the phase change material and to a coolant fluid inside of the heat exchanger.

While the invention has been described with reference to an exemplary embodiment(s), it will be understood by those skilled in the art that various changes may be made and equivalents may be substituted for elements thereof without departing from the scope of the invention. For example, while FIGS. 1-4 show heat exchanger 10 as having a plurality of phase change elements 14 inside of outer housing 12, in other examples, heat exchanger 10 can include a single phase change element 14 having a core 20 with a relatively complex geometry covered by membrane 22. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A heat exchanger comprising:

an outer shell enclosing an interior space;

an inlet extending through the outer shell and in fluidic communication with the interior space;

an outlet extending through the outer shell and in fluidic communication with the interior space; and at least one phase change element inside the interior space, wherein the at least one phase change element comprises:

a core comprising a phase change material and wherein the phase change material is tubular in shape; and a membrane that is tubular in shape and completely covering a surface area of the phase change material, and comprising an elastic material that is impermeable to the phase change material and a coolant fluid in the heat exchanger.

2. The heat exchanger of claim 1, wherein the phase change material is selected from the group comprising paraffin wax, hydrated salts, fatty acids, ice/water, shape memory alloys, gallium, and other metals with a melting point below 200° F.

3. The heat exchanger of claim 1, wherein the elastic material comprises ethylene propylene diene monomer.

4. The heat exchanger of claim 1, wherein the heat exchanger further comprises a plurality of phase change elements, and wherein the plurality of phase change elements comprises a second phase change element that is spherical in shape.

5. The heat exchanger of claim 4, wherein the core of the second phase change element is spherical in shape.

6. The heat exchanger of claim 5, wherein the second phase change element comprises a diameter that is larger than a diameter of the outlet and larger than a diameter of the inlet.

7. The heat exchanger of claim 1, wherein the heat exchanger further comprises a plurality of phase change elements, and wherein the plurality of phase change elements comprises a second phase change element that is cylindrical in shape.

8. The heat exchanger of claim 1, wherein the outer shell is a capsule-shaped pressure vessel formed from a composite material.

9. A heat exchanger comprising:

a plurality of phase change elements, wherein each phase change element of the plurality of phase change elements comprises:

a core comprising a phase change material;

an outer housing surrounding the plurality of phase change elements and forming flow channels between the outer housing and the plurality of phase change elements, wherein the outer housing extends from a first end to a second end;

an inlet formed in the outer housing and in fluidic communication with the flow channels; and an outlet formed in the outer housing and in fluidic communication with the flow channels, and wherein the plurality of phase change elements comprises:

a plurality of spherical phase change elements; and a plurality of elongated phase change elements, wherein the plurality of elongated phase change elements extends between the first end and the second end of the outer housing, extends over the inlet and over the outlet within the outer housing, and holds the plurality of spherical phase change elements in place and prevents the plurality of spherical phase change elements from moving into the outlet or the inlet.

10. The heat exchanger of claim 9, wherein at least one phase change element of the plurality of elongated phase change elements is cylindrical in shape.

11. The heat exchanger of claim 9, wherein at least one phase change element of the plurality of elongated phase change elements is tubular in shape.

12. The heat exchanger of claim 9, wherein the outer housing is a pressure vessel formed from a composite material.

13. The heat exchanger of claim 12, wherein the phase change material is selected from the group comprising paraffin wax, hydrated salts, fatty acids, ice/water, shape memory alloys, gallium, and other metals with a melting point below 200° F.

14. The heat exchanger of claim 13, wherein each phase change element of the plurality of phase change elements further comprises:

a membrane completely covering the core and comprising an elastic material that is impermeable to the phase change material.

15. The heat exchanger of claim 14, wherein the elastic material comprises rubber.

16. The heat exchanger of claim 13, wherein the elastic material is chemically non-reactive to the phase change material and to a coolant fluid inside of the heat exchanger.

* * * * *